US008950972B2

(12) United States Patent
Weaver

(10) Patent No.: US 8,950,972 B2
(45) Date of Patent: Feb. 10, 2015

(54) POLYURETHANE BASED ROAD FORMING

(71) Applicant: Sean Somers Weaver, Redding, CA (US)

(72) Inventor: Sean Somers Weaver, Redding, CA (US)

(73) Assignee: Technisoil Industrial LLC, Redding, CA (US)

( * ) Notice: Subject to any disclaimer, the term of this patent is extended or adjusted under 35 U.S.C. 154(b) by 43 days.

(21) Appl. No.: 13/856,223

(22) Filed: Apr. 3, 2013

(65) Prior Publication Data

US 2013/0216308 A1 Aug. 22, 2013

Related U.S. Application Data

(63) Continuation-in-part of application No. 13/772,307, filed on Feb. 20, 2013.

(60) Provisional application No. 61/601,018, filed on Feb. 20, 2012, provisional application No. 61/619,430, filed on Apr. 3, 2012, provisional application No. 61/700,338, filed on Sep. 13, 2012.

(51) Int. Cl.
*E01C 7/30* (2006.01)
*E01C 7/36* (2006.01)
*E01C 23/06* (2006.01)

(52) U.S. Cl.
CPC ..... *E01C 23/065* (2013.01)
USPC ..... 404/76; 404/75; 404/91

(58) Field of Classification Search
USPC ..... 404/75, 76, 90, 91
See application file for complete search history.

(56) References Cited

U.S. PATENT DOCUMENTS

| | | | | | |
|---|---|---|---|---|---|
| 2,394,017 | A | * | 2/1946 | Seaman | 404/95 |
| 3,719,050 | A | * | 3/1973 | Asao et al. | 405/264 |
| 3,818,711 | A | * | 6/1974 | Condo et al. | 405/129.9 |
| 3,847,722 | A | * | 11/1974 | Kistner | 428/76 |
| 3,909,474 | A | * | 9/1975 | Borchert et al. | 524/60 |

(Continued)

FOREIGN PATENT DOCUMENTS

| | | | |
|---|---|---|---|
| RU | 2117090 | C1 | 8/1998 |
| RU | 2373254 | C2 | 11/2009 |

(Continued)

OTHER PUBLICATIONS

"Int'l Application Serial No. PCT/US2013/035137, ISR&WO mailed Aug. 29, 2013", 11 pgs.

(Continued)

*Primary Examiner* — Gary Hartmann
(74) *Attorney, Agent, or Firm* — Kwan & Olynick LLP

(57) ABSTRACT

Provided herein are roadways containing polyurethane materials. A roadway includes a base layer of a compacted in situ material and/or a wear layer disposed on the base layer. One or both of these layers may include the polyurethane material to bind other components in the layers and to form more robust and durable roadway structures capable of withstanding operating loads of the roadway. In some embodiments, the polyurethane material is added to the wear layer by mixing in situ soil and/or foreign aggregate with polyurethane material or by dispensing the polyurethane material over the existing partially formed wear layer. The base layer may or may not include a polyurethane material. The type, concentration, distribution, and processing of the polyurethane material in the wear layer may be the same or different than that in the base layer.

20 Claims, 6 Drawing Sheets

(56) References Cited

U.S. PATENT DOCUMENTS

| | | | | |
|---|---|---|---|---|
| 6,521,673 | B1 * | 2/2003 | Brown | 521/130 |
| 8,075,063 | B2 * | 12/2011 | Mannebach et al. | 299/39.6 |
| 2009/0087262 | A1 * | 4/2009 | Tucker et al. | 404/75 |
| 2009/0095820 | A1 * | 4/2009 | Roser et al. | 238/2 |
| 2011/0217118 | A1 * | 9/2011 | Mohmeyer et al. | 404/31 |
| 2012/0189389 | A1 * | 7/2012 | Hicks et al. | 404/82 |
| 2013/0183094 | A1 * | 7/2013 | Redl et al. | 404/82 |
| 2013/0216307 | A1 * | 8/2013 | Weaver | 404/75 |
| 2014/0050525 | A1 * | 2/2014 | Yano et al. | 404/33 |

FOREIGN PATENT DOCUMENTS

| | | | |
|---|---|---|---|
| SU | 1636497 | A1 | 3/1991 |
| WO | 2011084802 | A1 | 7/2011 |
| WO | 2013152113 | A1 | 10/2013 |

OTHER PUBLICATIONS

Weaver, Sean S. , "System and Method of Forming a Roadway Comprising Polyurethane", U.S. Appl. No. 13/772,307, filed Feb. 20, 2013, 40 pgs.

"Russian Application Serial No. 2013154558, Office Action mailed Aug. 8, 2014", 3 pgs.

* cited by examiner

POLYURETHANE BASED ROAD FORMING

RELATED APPLICATIONS

This application is a continuation in part of U.S. Ser. No. 13/772,307, filed on Feb. 20, 2013, which claims the benefit of priority to U.S. Provisional Patent Applications No. 61/601,018, filed on Feb. 20, 2012, No. 61/619,430, filed on Apr. 3, 2012, and No. 61/700,338, filed on Sep. 13, 2012. All of the above-identified patent applications are herein incorporated by reference in their entireties for all purposes.

TECHNICAL FIELD

This description relates generally to the field of roadway forming and, more specifically, to systems and methods of forming roadways using various equipment, such as reclaimer-stabilizer machines, pug mills, pavers, hand tools, and the like, to apply polyurethane based materials into the roadways.

BACKGROUND

Typical roadways are made of concrete, asphalt, and compacted soil. These roadways are subject to extreme stresses from thermal cycling, vehicular traffic, and ultraviolet (UV) exposure, which eventually lead to defects in the roadway, such as cracks and potholes. Furthermore, concrete roadways require large amounts of heavy raw materials to be transported to the roadway building site, which is prohibitively expensive for roads placed in remote locations for access to mines, oil and gas pipelines, logging sites and the like. Asphalt may be used for applications that require a high level of durability. However, the cost of transporting the heavy raw materials needed for this system is also prohibitively expensive for many applications.

SUMMARY

Provided herein are roadways containing polyurethane materials. A roadway includes a base layer of a compacted in situ material and/or a wear layer disposed on the base layer. One or both of these layers may include the polyurethane material to bind other components in the layers and to form more robust and durable roadway structures capable of withstanding operating loads of the roadway. In some embodiments, the polyurethane material is added to the wear layer by mixing in situ soil and/or foreign aggregate with polyurethane material or by dispensing the polyurethane material over the existing partially formed wear layer. The base layer may or may not include a polyurethane material. The type, concentration, distribution, and processing of the polyurethane material in the wear layer may be the same or different than that in the base layer.

Furthermore, provided herein are methods of forming stabilized roadways. In some embodiments, the method involves pulverizing in situ soil using a reclaimer-stabilizer machine, spraying a liquid polyurethane composition (e.g., one or more polyurethane precursors) into the pulverized soil thereby forming a combination of the polyurethane and soil, and compacting the combination to form a roadway. In some embodiments, the liquid polyurethane is supplied from a pug mill attached directly to the reclaimer-stabilizer machine. In other embodiments the pug mill is provided in proximity to the reclaimer-stabilizer machine and connected in order to supply the liquid polyurethane to the dispensing portions of the reclaimer-stabilizer machine. The pug mill may be used to mix two or more polyurethane precursors and/or to mix one or more polyurethane precursors with all or part of the soil used for road building (e.g., in situ soil and/or foreign aggregate).

In some embodiments, two polyurethane precursors, i.e., a polyol and an isocyanate, are combined at the reclaimer-stabilizer machine (e.g., using a pug mill, in-line mixer, or some other means) and delivered into one or both layers of the roadway as a polyurethane mixture. For example, the reclaimer-stabilizer machine may be equipped with a mixing device, such as an in-line mixing device or a batch mixing device. However, the mixing device needs to be cleaned from the polyurethane mixture after completing the operation in order to prevent the mixture curing right in the mixing device and clogging the mixing device.

In some embodiments, two or more polyurethane precursors, i.e., a polyol and an isocyanate, are first dispensed into soil and then combined with each other, e.g., in a starting materials used to build one or both layers of the roadway. For example, one polyurethane precursor may be combined with a soil material outside of the reclaimer-stabilizer machine before being contacted with the second precursor. Specifically, the two precursors are dispersed individually into the starting material and then this starting material is thoroughly mixed together with the two precursors thereby combining the two precursors as well as combining the two precursors with the starting material.

Also provided herein is a method of forming a roadway. The method involves providing an existing asphalt or concrete roadway, pulverizing the asphalt or concrete surface into rubble, mixing the rubble with a polyurethane mixture to form a mixture, and pressing the mixture onto a foundation layer of soil. The mixture then cures thereby forming the roadway. The cured mixture may be substantially impermeable to the water. In some embodiments, the mixture may include one or more polyurethanes and a heat stabilizer.

In some embodiments, a method of forming a roadway involves providing a reclaimer-stabilizer machine. The reclaimer-stabilizer machine may be configured to pulverize an in situ soil and to deliver at least one polyurethane precursor into the pulverized in situ soil. The method may proceed with pulverizing the in situ soil using the reclaimer-stabilizer machine, and combining the pulverized in situ soil with the at least one polyurethane precursor using the reclaimer-stabilizer machine. This combining operation forms a polyurethane filled soil material. The polyurethane filled soil material may or may not include foreign aggregate. In some embodiments, the polyurethane filled soil material includes foreign aggregate but does not include pulverized in situ soil. This pulverized in situ soil may be prepared by the reclaimer-stabilizer machine or some other equipment, such as a pug mill. The method then proceeds with compacting the polyurethane filled soil material using the reclaimer-stabilizer machine thereby forming a layer of the roadway. In some embodiments, the layer of the roadway is a wear layer. The layer may be impermeable to water.

In some embodiments, the method also involves adjusting the moisture content of the pulverized in situ soil using the reclaimer-stabilizer machine. This adjusting may involve adding water into the pulverized in situ soil or removing water from the pulverized in situ soil using the reclaimer-stabilizer machine. For example, water may be removed by heating the soil or adding lime and/or other water trapping material into the soil. For example, the reclaimer-stabilizer machine may be equipped with a moisture content meter, water sprayers, and/or heaters for water evaporation. Furthermore, in some embodiments, the reclaimer-stabilizer machine may be configured to bring the temperature of the soil to the predetermined level to ensure various properties of the polyurethane (e.g., flowing characteristics, mixing characteristics, and curing characteristics).

In some embodiments, the at least one polyurethane precursor includes a first polyurethane precursor and a second polyurethane precursor. The first polyurethane precursor may be isocyanate, while the second polyurethane precursor may be polyol. In some embodiments, the first polyurethane precursor and the second polyurethane precursor are mixed using the reclaimer-stabilizer machine prior to dispensing into the pulverized in situ soil. Alternatively, the first polyurethane precursor and the second polyurethane precursor are mixed in the pulverized in situ soil after dispensing into the pulverized in situ soil using the reclaimer-stabilizer machine. In other words, the first precursor and the second precursor are independently dispensed into the in situ soil and only then mixed together and with the soil. In some embodiments, the first polyurethane precursor and the second polyurethane precursor are at least partially mixed during dispensing into the pulverized in situ soil using the reclaimer-stabilizer machine. In some embodiments, at least one polyurethane precursor includes isocyanate, while substantially no polyol is dispensed into the in situ soil.

In some embodiments, the method also involves adding a reinforced component into the pulverized in situ soil. The reinforced component may be basalt fibers, silica fibers, glass fibers, polypropylene fibers, or various combinations thereof. The reinforced component may be added as a part of the at least one polyurethane precursor. Alternatively, the reinforced component may be added separately from the at least one polyurethane precursor. In some embodiments, the reinforced component also includes a dispersing agent, which in turn includes sand. In some embodiments, at least one polyurethane precursor includes a heat stabilizer. Some examples of suitable heat stabilizers include aluminum hydroxide, magnesium hydroxide, antimony trioxide, antimony pentoxide, sodium antimonite, zinc borate, zinc stannate, zinc hydrostannate, red phosphorous, ammonium polyphosphate and combinations thereof.

In some embodiments, the layer of the roadway includes between 1% and 10% by weight of polyurethane. One or more polyurethane precursors may have a viscosity of between 20 Centipoise and 2000 Centipoise at 78 degrees Fahrenheit or, more specifically, between about 600 Centipoise and 1500 Centipoise or even between about 800 Centipoise and 1200 Centipoise. In some embodiments, the layer of the roadway has a thickness of between 0.5 inches and 15 inches.

In some embodiments, a method of forming a roadway involves delivering at least one polyurethane precursor into a pulverized in situ soil, mixing the pulverized in situ soil with the at least one polyurethane precursor such that this mixing forms a polyurethane filled soil material, compacting the polyurethane filled soil material thereby forming a layer of the roadway, and curing the polyurethane filled soil material thereby forming a cured layer. The cured layer is substantially impermeable to water.

Provided also is a reclaimer-stabilizer machine including a polyurethane precursor delivery unit configured for delivering at least one polyurethane precursor and a soil pulverization unit configured for pulverizing an in situ soil. At least some mixing of the at least one polyurethane precursor and the pulverized in situ soil may be performed by the soil pulverization unit. The reclaimer-stabilizer machine also includes a compacting unit for compacting a polyurethane filled soil material and forming an uncured layer of the roadway.

These and other embodiments are described further below with reference to the figures.

DETAILED DESCRIPTION

Figure 1:
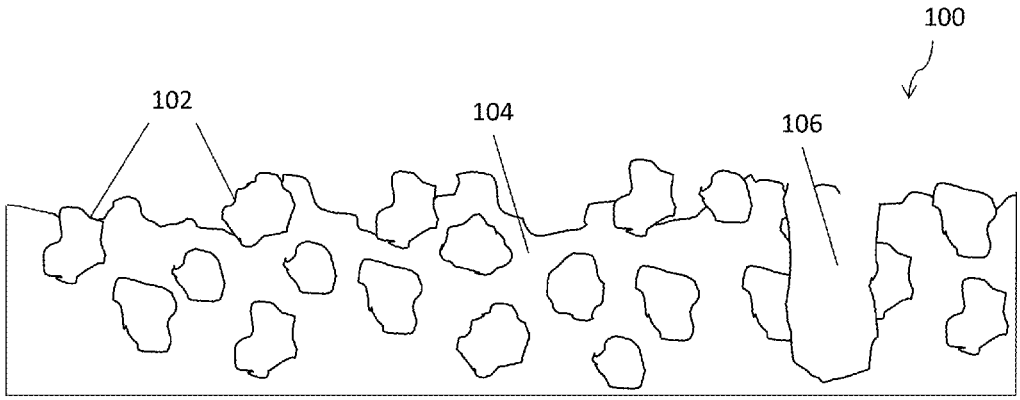
FIG. 1 is a cross-sectional view of a conventional asphalt paving system in accordance with certain embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Introduction

Conventional roadways include various materials, such as asphalt, concrete, compacted soil, and other like materials. Polymer materials are rarely used for binding soils. The ones that are used, such latex, easily degrade when exposed to environmental conditions, such as water, sunlight, mechanical stressors, and the like. One example of a conventional roadway is an asphalt concrete system or simply asphalt.

Asphalt is widely used as a paving material for roadways, airport runways, parking lots, and other paving applications. A conventional asphalt system includes a composite of a bitumen binder and a mineral aggregate, such as stone, gravel, or sand. Such systems are subjected to a variety of stressors, such as temperature variations, freeze-thaw cycles, and high forces that can cause degradation over time. For example, operating a typical paving system in a hot climate may cause deformation and migration due to the impressionability of the bitumen binder. UV exposure and oxidation are other common stressors that cause deterioration of the asphalt concrete paving systems. Petroleum erosion caused by spilled petroleum products is also commonly encountered with conventional asphalt since many bitumen binders can change their properties when they come in contact with the petroleum products.

Stressors described above can cause severe damage to the conventional asphalt systems in the form holes, cracks, and gaps. This damage requires expensive and labor intensive repairs to prevent exacerbation of the damage to the paving system and to prevent damage to vehicles or other equipment that utilize the paving system. Damage to the surface of the paving system can allow infiltration of water or other materials into the underlying foundation layers and compromise the structural integrity of the paving system, particularly during freeze-thaw cycles. For example, water may shift the ground soil of the underlying layers or may cause degradation of underlying metallic structural components.

Conventional asphalt methods and repair work requires high temperatures to melt bituminous binders and present a multitude of emissions issues. For example, a pothole is typically repaired using a tar or hot pour bituminous liquid, which is commonly transferred at 150° C. Alternatively, the tar or bituminous liquid is mixed with diesel or kerosene for transport which then is filtered out prior to application and is often subsequently disposed of thereby producing waste products. This type of repair work is expensive and labor intensive and may be repeated often in areas where stressors are particularly burdensome on the paving systems. The repair materials typically exhibit a different color profile than the underlying asphalt concrete resulting in an aesthetically unattractive paving application. Furthermore, construction of conventional roadways require large quantities of heavy raw materials to be transported to the paving site and may be prohibitively expensive if, for example, the road is to be paved in a remote location for access to mines, oil & gas pipelines, logging sites and the like.

Mechanical and chemical properties of the surface of conventional asphalt systems pose risks to vehicles traveling thereon if the surface is left untreated. For example, these systems have rough surfaces due to the composition of the asphalt. The roughness of the surface can be somewhat mitigated by utilization of mineral aggregate of a particular sizes. For example, a somewhat smoother surface may be achieved by utilization of a fine mineral aggregate as opposed to large-sized, jagged mineral aggregate. However, even with the use of fine mineral aggregate, the surface is rough and the asphalt pavement is susceptible to issues such as deformation and loss of matrix which can cause wear on the tires of vehicles that travel on the surface. Tire replacement accounts for a large portion of operating costs in many industries such as commercial transport industries and racing industries. Other hazards are posed by the surface of conventional asphalt paving systems, such as risk of hydroplaning in wet conditions due to the slick surface of the pavement. Loss of matrix, such as dislodging of loose mineral aggregate, can also cause damage vehicles by striking vehicles traveling on the surface. The rough surface can additionally make ice removal difficult as ice gets lodged in grooves of the rough topography of the surface of the pavement which can exacerbate dangerous travel conditions.

Provided are methods for forming roadways using polyurethane materials as well as equipment for form such roadways. In some embodiments, a reclaimer-stabilizer machine is used to pulverize an in situ soil and combined the pulverized in situ soil with at least one polyurethane precursor thereby forming a polyurethane filled soil material. In other embodiments, polyurethane may be combined with soil in a pug mill or other equipment. The method then proceeds with compacting the polyurethane filled soil material using reclaimer-stabilizer machine or other equipment. Some of these operations may be performed by other equipment as well, such as mixers and compactors, which may not be a part of the reclaimer-stabilizer machine. In some embodiments, a reclaimer-stabilizer machine is not used at all and the operations recited above performed by other types of equipment. Furthermore, the reclaimer-stabilizer machine may include multiple units responsible for different operations, such as a polyurethane supply unit, soil pulverization unit, and soil compaction unit.

Within the context of this disclosure, "in situ soil materials" refer to any pre-existing earthen materials such as sand, dust, clay, rock, and other earthen materials that are pre-existing at the site of road formation and which have not been transported thereto. On the other hand, any material (other than polyurethane precursors) that was not previously present in the ground may be referred to as "foreign aggregate". In other words, foreign aggregate is material that is brought up to the road building site from other locations, such as nearby excavation sites. Some examples of foreign aggregates include sand, gravel, crashed rock, and the like. Other examples of in situ soil materials and foreign aggregate are presented below. In some embodiments, both in situ soil materials and foreign aggregate are combined with one or more polyurethane precursors. Alternatively, only one of in situ soil materials and foreign aggregate may be combined with the polyurethane precursors. In some embodiments, foreign aggregate are not used for roadway forming and all materials (other than polyurethane precursors) and brought form the soil.

The pulverized in situ soil and/or foreign aggregate may be combined with one polyurethane precursor (e.g., isocyanate), two polyurethane precursors (e.g., isocyanate and polyol), or more polyurethane precursors. When a single polyurethane precursor is used, it reacts with materials present in the pulverized in situ soil, such as water. When multiple polyurethane precursors are used, these precursors may react with each other and, in some embodiments, water. As such, water content of the pulverized in situ soil may be closely controlled during the processing by adding and/or removing water from the pulverized in situ soil and/or from the in situ soil prior to pulverization. In some embodiments, the water content in the pulverized in situ soil is between 5% by weight and 20% by weight when mixing the pulverized in situ soil with the at least one polyurethane precursor. The water content may depend on the type of the pulverized in situ soil. For example, the water content of crashed granite may be about 5-10% by weight, while the water content of sandy loam may be about 10% by weight and 20% by weight.

Water curable polyurethane precursors may be an isocyanate or a prepolymer that includes some isocyanate. The level of free NCO may be between about 3% and 25%, in some embodiments. Various examples of isocyanates and prepolymers including prepolymers compositions are described below. These water curable polyurethane precursors may include between about 5% and 50% of naphthenic and aromatic process oils for lower viscosity and increasing the volume of the material (relative to the price) thereby increasing wet-ability characteristics.

When multiple polyurethane precursors are used, these precursors may be combined before being introduced into the pulverized in situ soil, while being introduced into the pulverized in situ soil, or after being introduced into the pulverized in situ soil. For example, an isocyanate may be mixed with a polyol in a batch mixer or using an in-line mixer prior to dispensing the mixture into the pulverized in situ soil. The batch mixing may be performed at a road building site to reduce the time between combining the two reactive components and introducing the mixture into the pulverized in situ soil. The batch mixing allows precisely controlling the composition, achieving good distribution of materials within the mixture, and making small batches of materials but may be disruptive in a continuous road building process. Inline mixers may provide effective mixing without a risk of premature curing since the material is dispensed into the pulverized in situ soil right after mixing. However, such mixers may need to be thoroughly cleaned or disposed of after each mixing operation. In some embodiments, two or more precursors are combined in a small portion of the mixer that can be later purged and cleaned with one of the precursors, air, and/or solvents.

At least some mixing may be achieved while dispensing two or more polyurethane precursors (previously unmixed) into the ground by specific orientation and design of dispensing nozzles, creating various air vortexes, and other like techniques. Further mixing of the multiple polyurethane precursors may be achieved in the pulverized in situ soil as further described below. In some embodiments, no prior mixing of polyurethane precursors is performed and all mixing is achieved after these precursors were introduced into the pulverized in situ soil. This feature reduces cleaning of the equipment components that comes in contact with the mixed polyurethane precursors. For example, a cutter/tilter of the reclaimer-stabilizer machine that is used to intermixed multiple polyurethane precursors and the pulverized in situ soil may be easily cleaned by tilting a gravel or some other abrasive aggregate that does not have dispensed polyurethane precursors.

In addition to streamlining the overall paving process and simplifying cleaning of the equipment, mixing multiple polyurethane precursors in the pulverized in situ soil ground allows more thorough distribution of the polyurethane precursors in the soil and using the soil as a mixing medium to achieve high shear mixing that may be particularly suitable when solid components are used in the polyurethane precursors, such as fibers. In some embodiments, the same cutter/tilter of the reclaimer-stabilizer machine that is used for pulverizing the in situ soil is also used for mixing the multiple polyurethane precursors in the pulverized in situ soil. In some embodiments, a reclaimer-stabilizer machine may be equipped with additional equipment that is used to further combine the one or more polyurethane precursors with the pulverized in situ soil. For example, another earth tilting device or earth mixing device may be provided on a reclaimer-stabilizer machine and positioned after the main cutter/tilter relative to the motion of the machine.

In some embodiments, all of the multiple polyurethane precursors are dispensed at the same location relative to the motion of the reclaimer-stabilizer machine. The same location dispensing may be help with mixing the precursors as some mixing will occur during the dispensing. In some embodiments, at least one precursor is dispensed at a different location. This feature may allow achieving at least some mixing between the pulverized in situ soil and one of the dispensed precursors before introducing another precursor and, e.g., reacting the two precursors. The same approach of staggered introduction of different polyurethane precursors may be used when polyurethane precursors are combined with foreign aggregate. Furthermore, staggered introduction of different polyurethane precursors may be used in a pug mill.

A roadway may include a base layer and a wear layer disposed on the base layer. One or both of these layers may include the polyurethane material in order to bind other components in the layers and to form more robust and durable structures capable of withstanding operating loads of the roadway. For example, the wear layer may include the polyurethane material, which may be applied as a liquid and, therefore, may be referred to as a liquid-applied polyurethane material. In some embodiments, the base layer includes a liquid-applied polyurethane material. The polyurethane material of the wear layer may be the same or different than the polyurethane material of the base layer. Furthermore, the concentration of the polyurethane material in the wear layer may be the same or different than the concentration of the polyurethane material of the base layer.

Roadway Formation Examples

Reclaimer-stabilizer machines and other types of equipment further described below may be used to prepare new surface materials from existing road beds by pulverizing a top portion of the road bed material and compacting the remaining portion. These machines may include rotating cutting assemblies, scrapers, augers and other systems designed to pulverize, reclaim, compact, and otherwise stabilize untreated in situ soil materials or an existing roadbed. Example reclaimer-stabilizer machines are made by Terex® in Westport, Conn. with Model No.'s R350 and R446 for smaller jobs with cut depths below 10 inches, and Model No. RS950B for roadways with up to a 20 inch cut depth, suitable for forming more durable base layers, in accordance with some embodiments.

In some embodiments, a reclaimer-stabilizer machine is deployed to a site where road formation is desired. The reclaimer-stabilizer machine is engaged to form wear layer and/or a base layer from in situ soil materials by pulverizing, cutting, and/or scraping the in situ soil materials and then compacting them into a dense or "stabilized" soil layer of the roadway. The base layer may be formed at 12 inches to 20 inches deep in the in situ soil material. The wear layer may have a thickness of between 0.5 inches to 16 inches or, more specifically, between 2 inches and 6 inches. The thickness of the wear layer depends on the application (e.g., load carrying requirement) of the roadway and integrity of the base. For example, the roadways used to support the foot traffic and light vehicle traffic (e.g., bicycles, golf carts, motorcycles, and the like) may have a wear layer that is as thin as 0.5 inches. The roads needed to support heavy equipment may have much thicker wear layers. In some embodiments, a wear layer may be used with substantially no base layer or the base layer with very little support. One example of such roadways is a road that undergoes multiple freeze-thaw cycles that causes movement of materials in the base layer. This road may be formed with a sufficiently strong wear layer that does not require much support from the base layer. This wear layer may be analogized with a crust of ice supported by the water. In some embodiments, the floating wear layer can be made wider than normally would be needed for a road (e.g., 40 feet wide) in order to distribute the load over a larger area. Therefore, polyurethane based roadways can be made to support large loads even with extremely weak and movable bases.

One or more polyurethane precursors may be delivered into the pulverized in situ soil, i.e., the in situ soil after it has been pulverized, at least partially. In some embodiments, the one or more polyurethane precursors are delivered into in situ soil, while this soil is being pulverized. The pulverization operation is used to provide some mixing to the soil and the polyurethane precursors and, in some embodiments, the entire mixing. Additional mixing may be provided after the pulverization operation. For example, additional tilting of the pulverized in situ soil containing the one or more polyurethane precursors may be performed.

The weight ratio of the in situ soil to the one or more polyurethane materials may be between about 30:1 and 10:1 or, more specifically, between about 25:1 and 12:1 or, even more specifically, between about 20:1 and 16:1. Even at a very low content of polyurethane, the resulting layer has a sufficient level of stabilization (such as "R-value") in comparison to conventional paving systems. Within the context of this disclosure, "R-value" is calculated using California Test 301, published March, 2000 by the Department of Transportation for the State of California, and which is incorporated herein by reference in its entirety. In relevant part, California Test 301 states, "The R-value of a material is determined when the material is in a state of saturation such that water will be exuded from the compacted test specimen when a 16.8 kN load (2.07 MPa) is applied. Since it is not always possible to prepare a test specimen that will exude water at the specified load, it is necessary to test a series of specimens prepared at different moisture contents." Further details related to R-value testing can be found in Chapter 600 of the California Highway Design Manual. The experimental results show R values of 25-48 for various types of soil and polyurethane loadings. For example, a sample prepared using a single pack polyurethane (i.e., water curable) having a loading of 5% by weight in decomposed granite (95% by weight) remonstrated an R-value of 41. When a 5.5% by weight of similar polyurethane was added to crushed stone (94.5% by weight), the R-value was 48. Finally, 3% of this polyurethane mixed with 97% of sandy loam yielded an R-value of 25. In some embodiments, the R-value of the resulting roadway is between about 15 and 60 for the wearing course (i.e., the top layer) or, more specifically, between about 30 and 50. A single pack polyurethane may include one or more diphenylmethane-diisocyanates (such as MONDUR® MRS 5 available from Bayer Material Science LLC in Pittsburgh, Pa.) and MONDUR® MR-Light also available from available from Bayer Material Science LLC in Pittsburgh, Pa.) and, for example, a catalyst. In specific embodiments, a weight ratio of MONDUR® MRS 5 in the formulation may be between about 50% and 90% or, more specifically, between about 60% and 80% or even more specifically between about 70% and 75%. A weight ratio of MONDUR® MR Light in the formulation may be between about 1% and 50% or, more specifically, between about 10% and 40% or even more specifically between about 20% and 30%.

Lower ratios of soil to polyurethane may be used to increase the level of stabilization, or R-value, as desired, for example 25:1, 22:1, or 20:1 ratios of soil to polyurethane provide increasing stability of the soil. In some embodiments, a base layer should employ ratio of greater than 22:1 (e.g., between about 22:1 and 30:1 or more specifically between 25:1 and 30:1) for applications that will receive an additional wear layer on top of the base layer. After formation of the base layer, a wear layer is added on top of the base layer. In some embodiments, the process does not involve a new formation of the base layer and the previously existing base layer is used.

Optionally, the base layer is allowed to cure before addition of the wear layer. Curing times for base layers formed with polyurethane are typically 8 hours to 48 hours depending on the moisture content and packing density of the base layer. The base layer may also include asphalt, cement, fly ash, or other materials commonly used to improve soil stabilization, and optionally may be given sufficient time for these materials to cure before the wear layer is added.

A wear layer may be formed over the base layer using a reclaimer-stabilizer machine and adjusting it to form shallower cut than used to form the base layer described above. Although a base layer is typically formed at 12 inches to 20 inches thick, a wear layer may be in the range of 1 to 8 inches thick, preferably 4 inches thick in some embodiments. The reclaimer-stabilizer machine may be adjusted as appropriate to make a shallower cut into the base layer at the desired thickness, for example 4 inches deep, and a liquid polyurethane mixture is applied during this process using spray heads in the reclaimer-stabilizer machine. For example, the reclaimer-stabilizer machine may be equipped with a sonar unit for controlling the profile of the soil and depth of the cutting/tilting. It was found that a preferred method of supplying liquid polyurethane to the reclaimer-stabilizer machine by way of a pug mill mixer in order to keep the polyurethane well mixed and capable of being readily dispensed as needed. In certain embodiments, the pug mill mixer is built-in or attached to the reclaimer-stabilizer tool. In other embodiments, the pug mill mixer is a separate system that supplies liquid polyurethane to the reclaimer-stabilizer machine and may be towed behind or transported in a separate vehicle. A preferred embodiment of pug mill mixer is a double shaft mixer with auger system, as commonly known in the art.

FIG. 1 is a cross-sectional view of a conventional asphalt paving system 100, in accordance with certain embodiments. The asphalt paving system 100 includes a mineral aggregate 102 and a polyurethane binder 104. The asphalt paving system further includes an aperture 106 or disruption in the surface of the asphalt paving system 100.

A reinforced or sealed paving system alleviates the roadway damage and tire wear issues described above, making the surface smoother and substantially preventing damage to the roadway from stressors such thermal cycling, UV exposure, oxidation, petroleum based erosion, and vehicular traffic as described above. The polyurethane material provides increased skid resistance and a high wet coefficient of friction to reduce risk of hydroplaning in wet conditions especially when the polyurethane material includes one or more fillers, such as fibers, sand and the like, in addition to polyurethane precursors. The smoothed topographical surface also improves the noise characteristics of the bituminous pathway and improves ride quality. Sealing and reinforcement of the bituminous pathway decreases matrix loss, which decreases damage to vehicles due to battering by loose mineral aggregate. Ice removal is also made easier through implementation of the smoother topographical surface.

Figure 2:
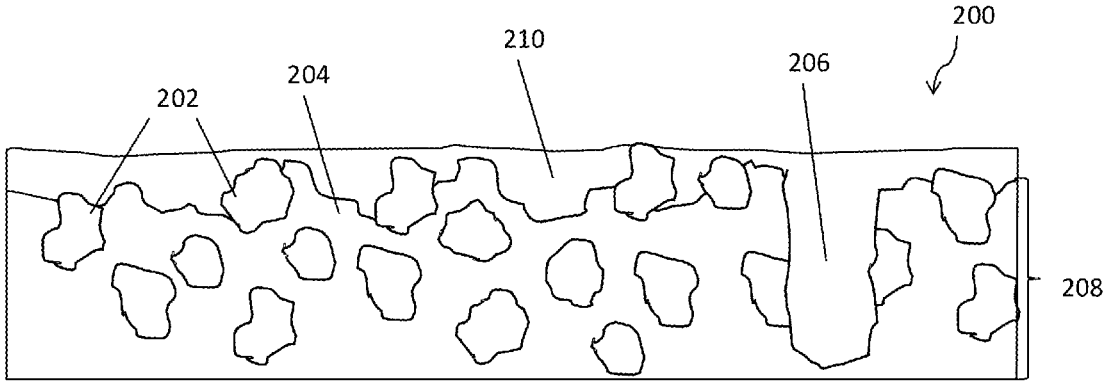
FIG. 2 is a cross-sectional view of a polyurethane based paving system in accordance with certain embodiments.

An asphalt concrete paving system may be sealed using a polyurethane material that coats a top surface of the paving system. In certain embodiments, the material may be applied by spraying a polyurethane mixture on the top surface of an asphalt concrete paving system to create a sealed bituminous pathway. FIG. 2 is a cross-sectional view of a stabilized roadway 200, in accordance with certain embodiments. The stabilized roadway 200 includes a base layer 208. Base layer 208 may include larger aggregate particulates 202 and smaller aggregate particulates 204. Smaller aggregate particulates 204 form voids in between larger aggregate particulates. Larger aggregate particulates 202 and smaller aggregate particulates 204 may be formed from in-situ soil and/or foreign aggregate. An aperture 206 is disposed in the base layer 208. A sealing layer 210 is disposed on the base layer 208 substantially covering a top surface of the base layer and filling the space of the aperture. The top surface of the sealing layer 210 includes a substantially continuous and uniform topography in contrast to the top layer of the base layer 208, which includes a jagged and disrupted topography.

In some embodiments, a reinforced paving system may be provided. An existing asphalt paving system may be pulverized to form bituminous rubble and mixed with one or more polyurethane precursors to create a mixture. The mixture may then be distributed over a treated or untreated foundation and allowed to cure. In addition to providing a more structurally sound paving structure, these embodiments also provide a method of recycling existing asphalt paving. Recycling or reclaiming existing asphalt paving eliminates the need to acquire new mineral aggregate, saving money, reducing use of natural resources, and eliminating the need to landfill the asphalt waste. When reclamation is completed on site, transportation costs are also greatly reduced due to elimination of the need to ship in additional aggregate and the need to haul the removed asphalt paving material to a landfill.

Reclamation and recycling of paving systems that may otherwise be thrown into landfills or burned may lead to opportunities for acquisition of carbon credits for the parties involved in the installation and upkeep of the paving system. The use of a polyurethane material as a sealing agent or repair agent reduces the amount of environmentally detrimental emissions that are commonly associated with standard paving installation and repair techniques and with replacement of existing paving systems. Emission reduction efforts associated with the use of polyurethane materials may also provide the opportunity for acquisition of carbon credits.

The polyurethane material may be used in combination with other carbon credit programs. For example, polyurethane materials may be used in combination with bioasphalts in certain embodiments. Bioasphalts may include asphalt concrete having bitumen made from sugar, molasses, rice, corn starch, potato starch, or from the fractional distillation of motor oil. Bioasphalts provide additional benefits in that they exhibit a variety of colors depending on the embodiment. Generally, surfaces with a lighter color absorb less heat than those of darker color. Bioasphalts are used, for example, in areas that are prone to the urban heat island effect in an effort to decrease the heat absorbed by the surface. Use of polyurethane materials in combination with bioasphalts may provide the opportunity for the acquisition of additional carbon credits.

Figure 3:
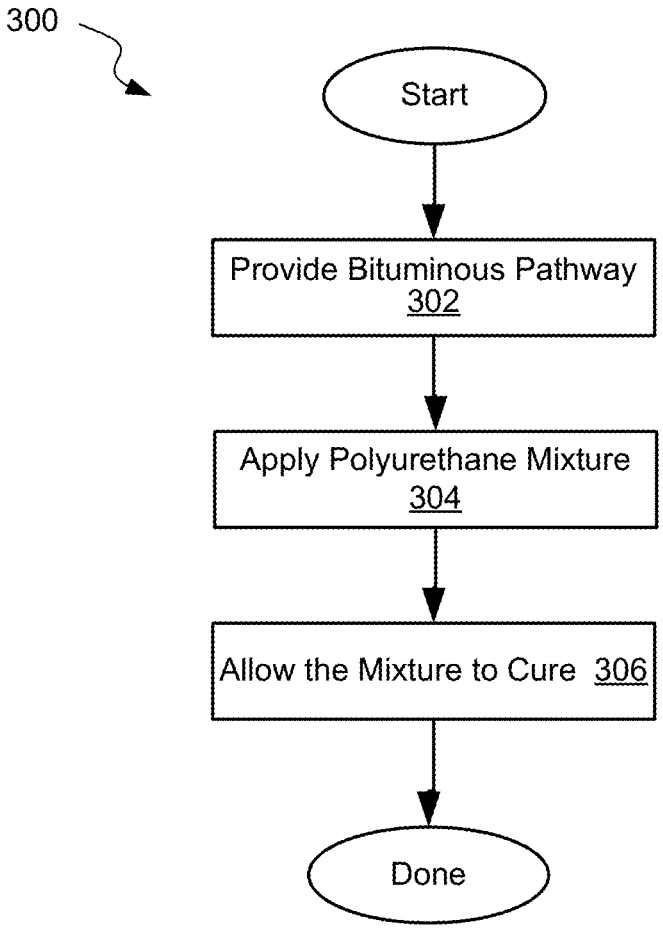
FIG. 3 is a flow chart of a process for making a polyurethane roadway in accordance with certain embodiments.

FIG. 3 is a flowchart illustrating various operations of process 300 for making a sealed pathway, in accordance with certain embodiments. Process 300 may start with providing a pathway in operation 302. For example, a bituminous pathway may be provided. Process 300 may proceed with applying a polyurethane mixture on a top surface of the pathway in operation 304. In certain embodiments, applying a polyurethane mixture on a top surface of the pathway may include spraying the polyurethane mixture on the top surface of the pathway using an airless sprayer to form a continuous and uniform surface. In other embodiments, applying a polyurethane mixture on the top surface of the pathway may involve pouring the polyurethane mixture on the top surface and spreading the polyurethane mixture on the top surface to form a substantially continuous and uniform surface. Process 300 may proceed by allowing the polyurethane mixture to cure to form a sealing layer in operation 306. Optionally, the step of allowing the polyurethane mixture to cure may include using artificial means to speed curing time, for example through the use of air streams or application of heat. Optionally, a step of applying additional surface texturing may be employed at the same time or before the step of allowing the polyurethane mixture to cure.

In certain embodiments, a reinforced bituminous pavement may be fabricated by recycling an existing asphalt paving system. For example, an existing asphalt paving system may be reclaimed on site and the asphalt concrete pulverized to form bituminous rubble of a desired size and consistency. The rubble may then be mixed with a polyurethane mixture to create a mixture, which may then be applied to a foundation and allowed to cure. The polyurethane acts as a binder for the reclaimed rubble. Reclamation of the asphalt concrete may be followed by immediately pulverizing the material and mixing the polyurethane material on site using a mobile reclaimer and a mobile mixer. The polyurethane mixture in a reinforced bituminous pavement may cover an area of 20 to 50 square feet per gallon, such as 20 to 30 square feet per gallon.

Figure 4:
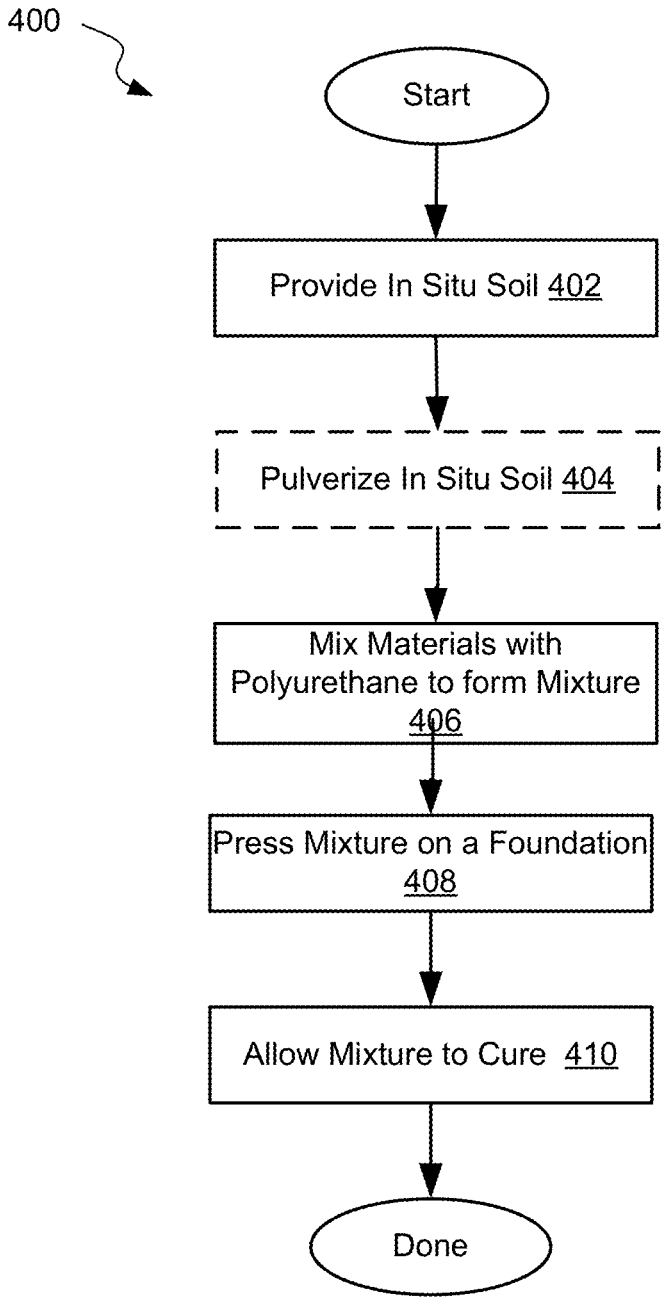
FIG. 4 is a flow chart of a process for making a reinforced polyurethane roadway in accordance with certain embodiments.

FIG. 4 is a flowchart illustrating various operations of process 400 for making a new roadway, in accordance with certain embodiments. A roadway may be a road for driving cars (e.g., a 10 foot wide roadway), a walkway (e.g., a sidewalk, a park pathway), a base for railroad tracks, a parking lot, and the like. A new roadway may be built over an existing roadway, which may include, e.g., a reinforced bituminous pavement. The existing roadway may be used to provide a base layer. For example, the base layer may be left intact or a new base layer may be formed at least in part from the materials of the existing base layer. As such, materials of the existing roadways are referred to as in-situ soil materials. Alternatively, a new roadway may be built at a location that did not previously have any roadways. The materials present in the ground may be also referred to in-situ soil materials. Regardless of presence or absence of previous roadways, in-situ soil materials may be used to form a new roadway. These in in-situ soil materials may be pulverized or not. If pulverized, the in-situ soil materials may be combined with at least one polyurethane precursor and, in some embodiments, foreign aggregate. Furthermore, various reinforcement components, such as basalt fibers, silica fibers, glass fibers, and polypropylene fibers, may be added as foreign aggregate or as a part of one or more polyurethane precursors. Overall, process 400 may start with providing in-situ soil during operation 402. In some embodiments, the in-situ soil provided during operation 402 may be a previous asphalt road. This type of a road may include a cured asphalt concrete composite that may be pulverized (as explained below) or left intact as a base layer.

In some embodiments, process 400 may involve providing a reclaimer-stabilizer machine. Examples of various reclaimer-stabilizer machines are described below with reference to FIGS. 7A and 7B. The reclaimer-stabilizer machine may be configured to pulverize an in situ soil and to deliver at least one polyurethane precursor into the pulverized in situ soil as further described below.

Process 400 may proceed with pulverizing the in situ soil during an optional operation 404. For example, the cured asphalt concrete composite may be pulverized into bituminous rubble. Optionally, the step of pulverizing the cured asphalt concrete composite into rubble may be preceded by a step of removing the cured asphalt concrete composite from a foundation. In some embodiments, the in situ soil is not pulverized and is used as a base layer. The polyurethane materials may be poured over the in situ soil allowing some of the polyurethane materials to penetrate into the in situ soil. Furthermore, foreign aggregate may be supplied and combined with the polyurethane materials and this combinations layer over the in-situ soil.

Operation 404 may involve cutting and tilting the in situ soil using the cutting wheel of the reclaimer-stabilizer machine. The level of pulverization may be determined by the design of the cutting wheel, the rotation speed of the wheel, the linear speed of the reclaimer-stabilizer machine, and other factors. In some embodiments, the linear speed of the reclaimer-stabilizer machine is between about 0.1 miles per hour and 2.5 miles per hour or, more specifically, between about 0.5 miles per hour and 1.5 miles per hour. The reclaimer-stabilizer machine may be equipped with a sonar system to control the depth of pulverization. In some embodiments, the reclaimer-stabilizer machine is equipped with a Global Positioning System (GPS) to control the speed and position of the reclaimer-stabilizer machine. In addition to controlling the speed of the reclaimer-stabilizer machine, pulverization may be controlled by adjusting the clearance between the cutting/tilting wheel and blades and walls of the compartment surrounding the wheel. The clearance may be varied between 0.5 feed and 2 feet in some embodiments.

Process 400 then involves delivering at least one polyurethane precursor into the in situ soil or into foreign aggregate. The at least one polyurethane precursor may be delivered into the soil prior to its pulverization, during its pulverization, and/or after its pulverization as further described below with reference to FIG. 7A. When multiple precursors are used, different precursors may be added at different stages of the pulverization process (i.e., before, during, or after). When one or more precursors are added after the in situ soil was pulverized, additional tilting of the soil may be provided to ensure mixing of the in situ soil and the precursors.

When multiple precursors are used, these precursors may be mixed together before being dispensed into the soil, while being dispensed into the soil, and/or after being dispensed into the soil. Pre-mixing precursors before dispensing may be used to ensure adequate contact between different precursors. However, the mixture often needs to be thoroughly cleaned from the equipment after dispensing is completed to avoid curing of the polyurethane right in the equipment. Mixing of the precursors in the soil may help to disperse some of the precursors and through wetting of in situ soil with one or more component prior to dispensing another component. For example, water may be used as one of the polyurethane precursors and may be already present in the soil or introduce early on the process. On the other hand, a catalyst may be the last precursor introduced into the soil. Delaying the catalyst introduction may be used to ensure adequate mixing of the in situ soil with other precursors before curing the polyurethane. In other words, curing is delayed, which allows to perform other operations, such as mixing.

The amount of polyurethane precursors dispensed into the in situ soil depends on design of the roadway (e.g., desired strength), type of the in situ soil, type of polyurethane precursors, and other factors. In some embodiments, the weight ratio of all polyurethane precursors to the in situ soil that received these precursors may be between about 2% by weight and 20% by weight or, more specifically, between about 5% by weight and 10% by weight. It should be noted that some in situ soil and even some pulverized in situ soil may be substantially free from the polyurethane precursors and this soil is not used to determine the weight ratio of the polyurethane precursors. Furthermore, distribution of the polyurethane precursors in the pulverized in situ soil may be uneven. For example, there may be more polyurethane precursors closed to the surface of the roadway than away from the surface. In some embodiments, the roadway may have two or more distinct layers that differ based on amount of polyurethane precursors provided in these layers.

In some embodiments, process 400 may proceed with mixing the in situ soil (e.g., pulverized in situ soil or even more specifically pre-bituminous rubble) with one or more polyurethane precursors (e.g., a polyurethane mixture) to form a mixture in operation 406. Mixing of precursors and in situ soil may be performed using the same device that is used to pulverize the in situ soil. In some embodiments, additional devices may be used to ensure adequate mixing of the previously pulverized soil and polyurethane precursors. For example, one device may be used to pulverize the in situ soil while another device may be used to mix the pulverized in situ soil with one or more polyurethane precursors. In some embodiments, both of these devices may be used for mixing the in situ soil with the one or more polyurethane precursors. In other words, some intermixing may occur during pulverization of the in situ soil and additional mixing is provided by other equipment.

Process 400 may proceed with pressing the mixture onto a paving foundation layer in operation 408. Various types of equipment may be used for this purpose, such as one or more rollers, vibrating soil compactor, rammers, plate compactors, and the like. In some embodiments, the roller may be a sheeps-foot drum and/or vibrating roller. Overall, any of the following compacting method may be used: static, impact, vibrating, gyrating, rolling, kneading, and various combinations thereof. In some embodiments, the soil compaction is at least about 90% or even at least about 95% after operation 408.

Optionally, operation 408 may be preceded by a step of treating the paving foundation in preparation for application of the mixture. The optional step of treating a foundation may involve smoothing or leveling of a soil layer and/or application of a gravel base layer. Process 400 may proceed with allowing the mixture to or, more specifically, the polyurethane precursors in the mixture cure in operation 410. Optionally, curing may involve using artificial means to expedite the curing time, for example, by using air streams or application of heat. In some embodiments, texturing of the roadway layer is performed before the polyurethane precursors are completely cured, e.g., within 8 hours from compaction operation 408 or, more specifically, within 4 hours or even within 2 hours. Optionally, a step of applying additional surface texturing may be employed at the same time or before the step of allowing the mixture to cure.

Figure 5:
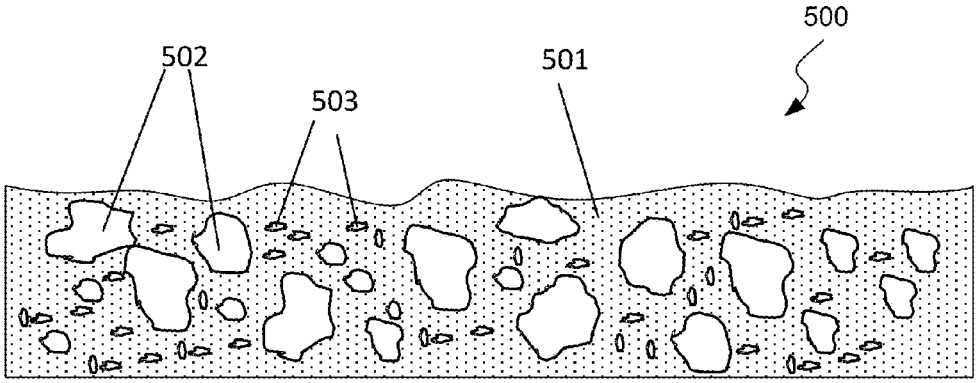
FIG. 5 is a cross-section view of a polyurethane based paving system in accordance with certain embodiments.

FIG. 5 is a cross-sectional schematic view of a polyurethane based paving system 500, in accordance with certain embodiments. Paving system 500 includes large particulates 502 (e.g., a mineral aggregate), small particulates 503 (e.g., sand, dust, dirt, fibers, and the like), and polyurethane binder 501. In some embodiments, some or all of large particulates 502 are formed by pulverization of in situ soil. In the same or other embodiments, some or all of large particulates 502 may be added to the in situ soil. Likewise, in some embodiments, some or all of small particulates 503 are formed by pulverization of in situ soil. In the same or other embodiments, some or all of small particulates 503 may be added to the in situ soil. If particulates (large and/or small) are added into the in situ soil, these particulates may be first pre-mixed with one or more polyurethane precursors, dispensed into the pulverized in situ soil, and/or dispensed into the in situ soil during or before its pulverization. For example, fibers may be added to one of the polyurethane precursors or dispensed right into the pulverized in situ soil.

FIG. 5 illustrates paving system 500 as a single layer that may be provided over a base (not shown), which may or may not include a polyurethane binder. The distribution of large particulates 502 and/or small particulates 503 may be uniform within this layer (shown in FIG. 5) or non-uniform (not shown). For example, more large particulates 502 may be position away from the surface of the layer whole more small particulates 503 may be positioned closer to the surface of the layer. Such distribution may be used to form paving systems with substantially uniform surfaces. In the similar manner, the distribution of polyurethane binder within the layer may be uniform or non-uniform. Polyurethane binder 501 is employed to improve the R-value and stability of the roadway. In this embodiment, a single set of operations described above is used to form paving system 500 and no additional wear layer is formed over this paving system 500.

Figure 6:
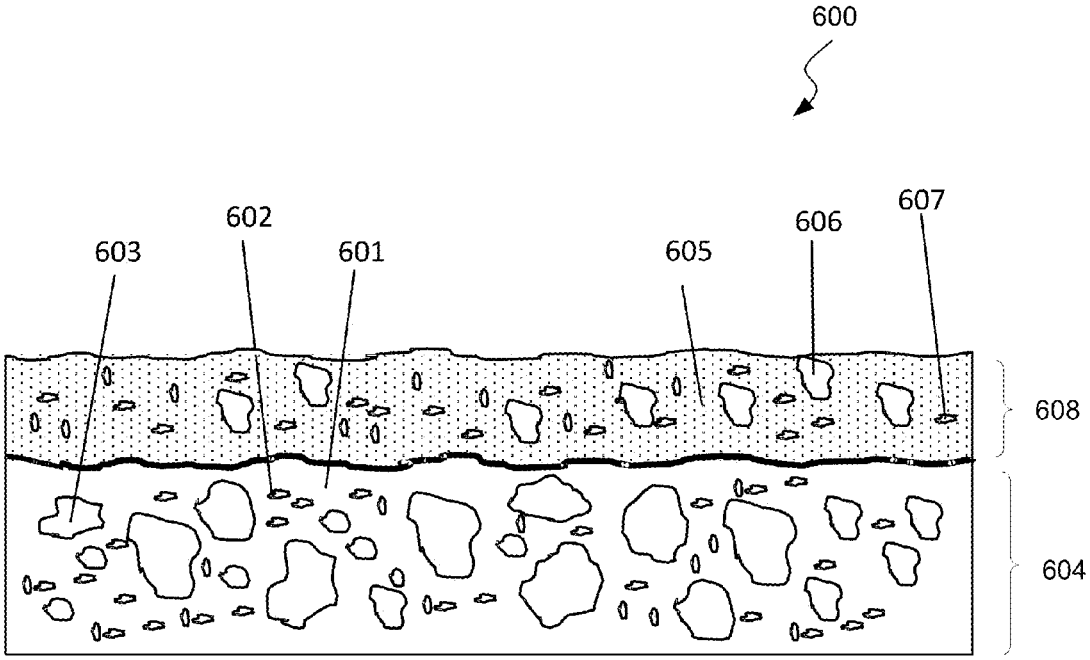
FIG. 6 is a cross-section view of a polyurethane based paving system in accordance with certain embodiments.

FIG. 6 is a cross-sectional schematic view of a polyurethane based paving system 600, in accordance with certain embodiments. Paving system 600 includes large particulates 603 (e.g., a mineral aggregate) combined with small particulates 602 (e.g., formed from in situ soil). Some examples of small particulates 602 include sand, dust, dirt and the like. A polyurethane binder 601 is employed to improve the R-value and stability of base layer 604 of the roadway. In this embodiment, two separate layers of paving system 600 are formed using the reclaimer-stabilizer machine, base layer 604 and wear layer 608. Wear layer 608 is typically thinner than base layer 604. Wear layer 608 may be used to improve the resistance of the roadway to vehicular traffic.

Reclaimer-Stabilizer Machine Examples

Figure 7A:
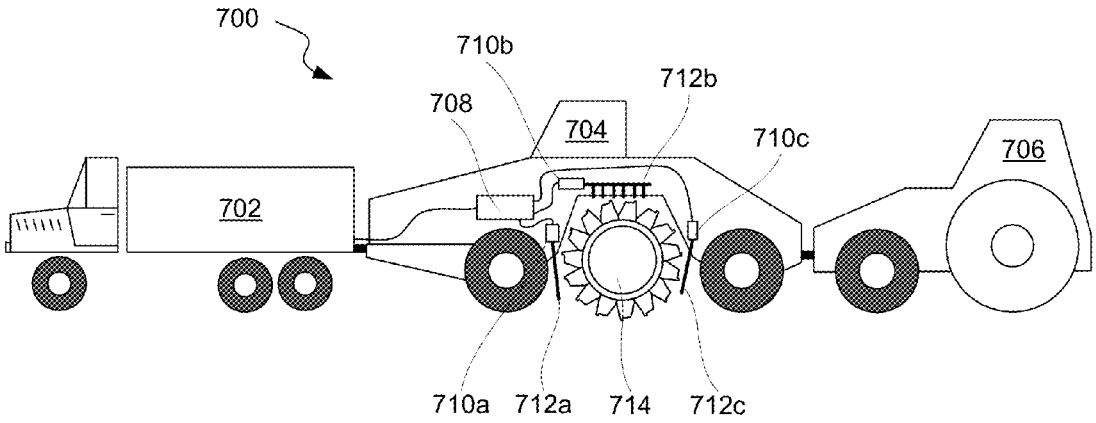
FIG. 7A is a schematic representation of a reclaimer-stabilizer machine, in accordance with some embodiments.

FIG. 7A is a schematic representation of a reclaimer-stabilizer machine 700, in accordance with some embodiments. Reclaimer-stabilizer machine 700 may be used to prepare new surface materials from existing road beds by pulverizing the road bed material and by compacting the remaining soil. Reclaimer-stabilizer machine 700 may include a rotating cutting assembly, one or more scrapers, augers and other systems designed to pulverize, reclaim, compact, and otherwise stabilize treated or untreated in situ soil materials or an existing roadbed. Specifically, reclaimer-stabilizer machine 700 may be configured to perform one or more of the following operations: pulverize an in situ soil, deliver at least one polyurethane precursor, mix the delivered polyurethane precursors with the in situ soil to form a mixture, and to compact the mixture. In some embodiments, reclaimer-stabilizer machine 700 is configured to perform fewer operations or more operations. For example, a soil compaction may be performed by some equipment other than reclaimer-stabilizer machine 700. In the same or another example, reclaimer-stabilizer machine 700 may be also configured to add additional aggregate into the in situ soil (e.g., rocks, fibers) that was not originally present in the in situ soil.

Reclaimer-stabilizer machine 700 shown in FIG. 7A includes three units: a polyurethane supply unit 702, soil pulverization unit 704, and soil compaction unit 706. Polyurethane supply unit 702 is configured to supply one or more polyurethane precursors. It may be in the form of a truck with one or more container including polyurethane precursors. In some embodiments, totes or drums are positioned on the truck. Soil pulverization unit 704 may be configured to pulverize in situ soil and may include a soil cutting/tilting wheel. Soil compaction unit 706 may include may include a sheepfoot drum and/or vibrating roller. In some embodiment, soil compaction unit 706 also includes a row of rubber tires that further assist with compaction of the soil. In some embodiments, reclaimer-stabilizer machine 700 includes fewer or more units. For example, polyurethane supply unit 702 may be combined with soil pulverization unit 704 and/or soil compaction unit 706. One such example is further described below with reference to FIG. 7B.

In addition to supplying one or more polyurethane precursors, pulverizing in situ soil, and compacting the soil, reclaimer-stabilizer machine 700 is also configured to mix the polyurethane precursors with each other (if multiple precursors are used) and with the pulverized in situ soil. FIG. 7A illustrates that soil pulverization unit 704 is configured to perform such function. However, other units may be used as well to perform these functions. Specifically, soil pulverization unit 704 is shown to include a pump 708 for pumping one or more polyurethane precursors from polyurethane supply unit 702. In some embodiments, each of the polyurethane precursors has a designated pump. Soil pulverization unit 704 is shown to include polyurethane precursor mixers 710*a*-710*c* and polyurethane precursor dispensers 712*a*-712*c*. While three sets are shown (each including one mixer and one dispenser), any number of sets can be used. Furthermore, one mixer can be supply multiple dispenser. In some embodiments, a mixer and a dispenser may be integrated into the same device. The dispensers may dispense mixed polyurethane precursors prior to pulverizing the soil (e.g., dispenser 712*a*), while pulverizing the soil (e.g., dispenser 712*b*), and/or after the soil was pulverized (e.g., dispenser 712*c*).

Figure 7B:
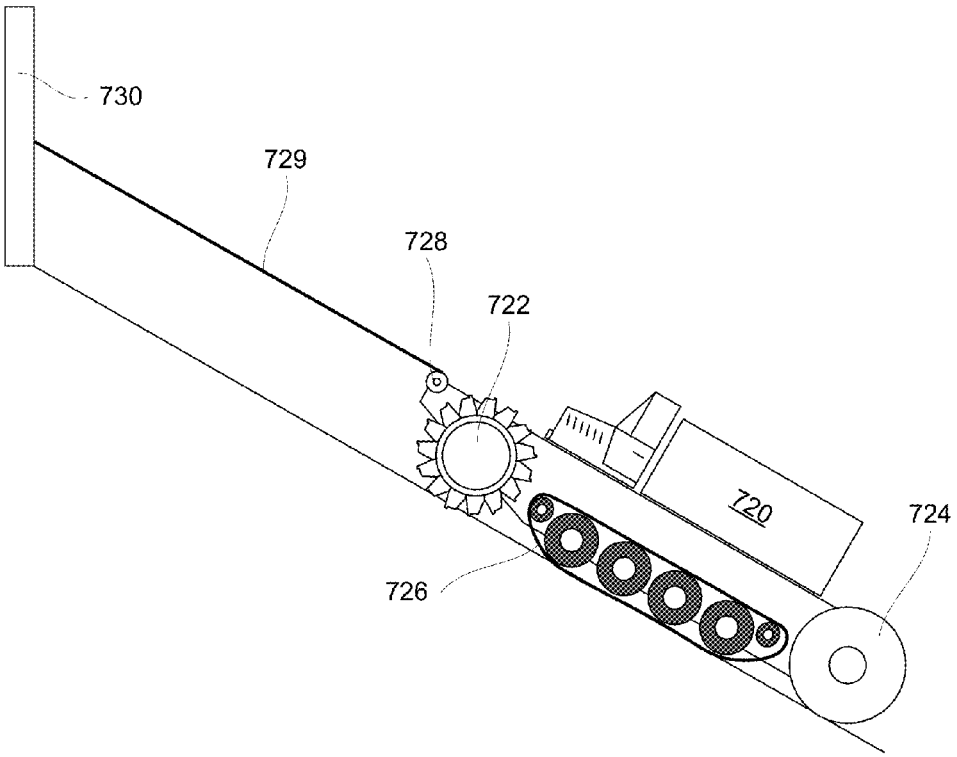
FIG. 7B is a schematic representation of another reclaimer-stabilizer machine, in accordance with some embodiments.

FIG. 7B is a schematic representation of another reclaimer-stabilizer machine 720, in accordance with some embodiments. This reclaimer-stabilizer machine 720 represents a single unit and may be used for operations on steep hills and other hard to reach areas. All road forming operations are performed by this single unit. In order to access hard to reach places, reclaimer-stabilizer machine 720 uses tracks 726 (instead of wheels) and may be equipped with a winch 728. During operation, winch 728 may be connected to another object 730 by cable 729 providing additional force to move reclaimer-stabilizer machine 720. Reclaimer-stabilizer machine 720 includes cutting/tilting wheel 722 as well as soil compacting drum 724. Polyurethane dispensing system is not shown but it may be similar to the ones described above with reference to FIG. 7A.

Figure 8:
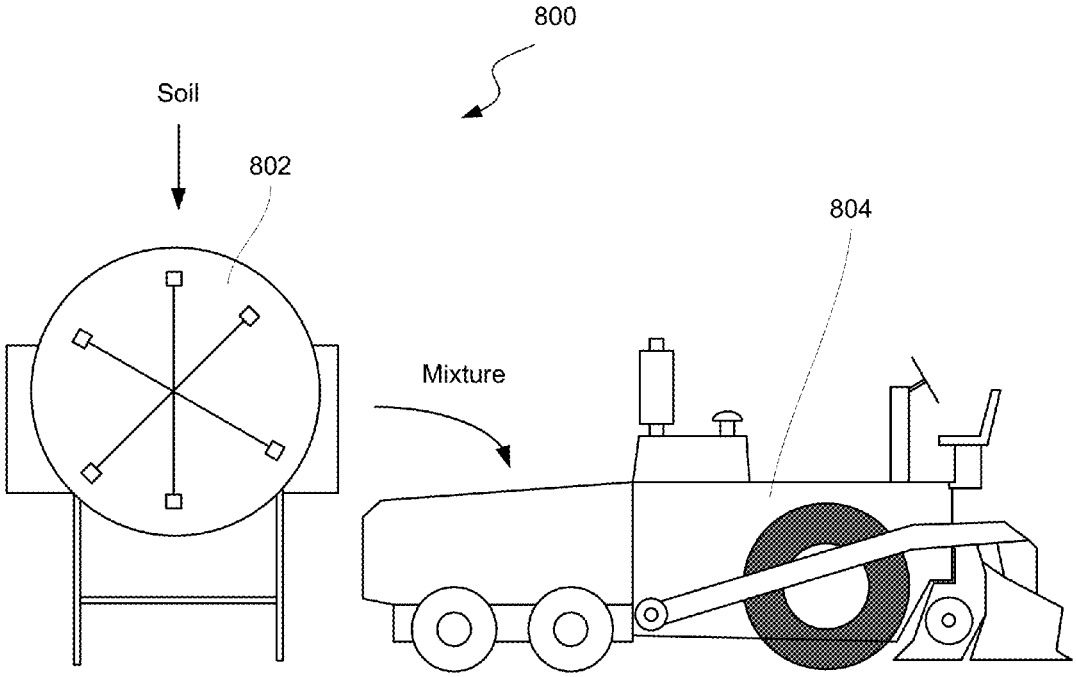
FIG. 8 is a schematic representation of a road paving system having a pug mill and a paver, in accordance with some embodiments.

FIG. 8 is a schematic representation of a road paving system 800, in accordance with some embodiments. Road paving system 800 may include a pug mill 802 and a paver 804. Pug mill 802 may be used to mix soil with one or more polyurethane precursors. For example, a dispersed in-situ soil or foreign soil may be loaded into pug mill 802 and combined with the one or more polyurethane precursors. In some embodiments, additional polyurethane precursor may be added to the mixture after it is unloaded from pug mill 802. Furthermore, the mixture unloaded from pug mill 802 may be combined with additional soil during forming the pavement. In these embodiments, road paving system 800 may also, for example, a soil pulverization unit, such as the one described above with reference to FIG. 7A. In some embodiments, a mixture that comes out of pug mill 802 does not include any polyurethane. For example, a reinforcement fiber may be combined with one or more aggregated to form a mixture that is later combined with polyurethane precursors.

Pug mill 802 may be a machine, in which materials are simultaneously ground and mixed, sometimes mixed with polyurethane. In some embodiments, pug mill 802 is a continuous mixer that may be provided on one of the units described above with reference to FIGS. 7A and 7B. A continuous pug mill can achieve a thoroughly mixed, homogeneous mixture in a short period of time (e.g., a few seconds). This time may represent a residence time of the materials in the continuous pug mill. Mixing materials at high solid content requires the forced mixing action of the pug mill paddles. Pug mill 802 may include a horizontal boxlike chamber with a top inlet and a bottom discharge at the other end. Pug mill 802 may include two shafts with opposing paddles and a drive assembly.

Paver 804 may be similar to pavers used for to lay asphalt on roads, bridges, parking lots and other such places. The mixture may be delivered from pug mill 802 and into the paver's hopper. The conveyor of paver 804 may then carry the mixture from the hopper to the auger. The auger places a stockpile of material in front of the screed. The screed in turn takes the stockpile of material and spreads it over the width of the road and provides primary compaction. A compactor (not shown) may also be a part of road paving system 800 and may follow paver 804.

In some embodiments, other types of mixers (e.g., blade or double-blade mixers) may be used. Other types of equipment may include dump truck, skid steer, skip loader, loader, roller, and variety of hand tools, such as vibratory plate compactor and hand tamper.

Polyurethane Material Examples

One or more polyurethane precursors used for forming roadways may include one or more isocyanates (e.g., prepolymer isocyanates), one or more polyol, a heat stabilizer, a filler material, and/or other materials. Some examples of these other materials include catalysts, dyes, pigments, surfactants, plasticizers, solvents, blowing agents, dispersants, cross linkers, flame retardants, light stabilizers, acid scavengers, antistatic agents, and antioxidants. All these materials are collectively referred to herein as precursors. The precursors are used to for a polyurethane mixture before dispensing the precursors into a pulverized in situ soil, during dispensing the precursors into the soil, and/or after dispensing the precursors into the soil.

Polyurethane is formed from the reaction of a monomeric or polymeric isocyanate with a polyol. An isocyanate use for road forming applications may include one or more isocyanate (NCO) functional groups, typically at least two NCO functional groups. Suitable isocyanates include, but are not limited to, conventional aliphatic, cycloaliphatic, aryl and aromatic isocyanates. Some more specific examples include diphenylmethane diisocyanates (MDIs), polymeric diphenylmethane diisocyanates (PMDIs), and combinations thereof. Polymeric diphenylmethane diisocyanates may be also referred to as polymethylene polyphenylene polyisocyanates. Examples of other suitable isocyanates include, but are not limited to, toluene diisocyanates (TDIs), hexamethylene diisocyanates (HDIs), isophorone diisocyanates (IPDIs), naphthalene diisocyanates (NDIs), and combinations thereof. One or more of these isocyanates may be used to form an isocyanate-prepolymer.

In certain embodiments, a monomeric MDI or a polymeric MDI may be used. MDI polyurethanes have been found to have favorable thermal stability, which may be useful in some road applications. Additionally, MDI polyurethanes exhibit excellent adhesion to both concrete and steel. The basic structures of monomeric MDI and polymeric MDI are shown below.

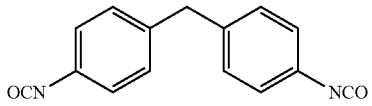

4,4′-MDI

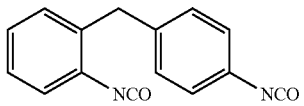

2,4′-MDI

Monomeric MDI

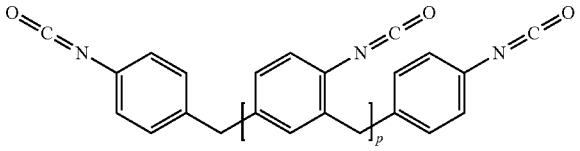

Polymeric MDI

An isocyanate-prepolymer may be formed by combining an isocyanate with a polyol. The amount of polyol is limited to react only with some NCO functional groups of the isocyanate. For example, the polyol includes one or more hydroxyl (OR) functional groups, or more specifically at least two OR functional groups. The polyol can be any type of polyol. Some examples of suitable polyols include ethylene glycol, diethylene glycol, propylene glycol, dipropylene glycol, butanediol, glycerol, trimethylolpropane, triethanolamine, pentaerythritol, sorbitol, and combinations thereof.

The polyol can be used in various amounts relative to the isocyanate to form isocyanate-prepolymer, as long as an excess of NCO functional groups relative to OR functional groups are present prior to reaction such that the isocyanate-prepolymer, after formation, includes NCO functional groups for subsequent reaction to form polyurethane. The isocyanate-prepolymer may have an NCO content of between about 18% by weight and 28% by weight or, more specifically, between about 20% by weight and 25% by weight, such as about 22.9% by weight.

An isocyanate-prepolymer may be formed from a polyamine with one or more amine functional groups, such as at least two amine functional groups. The polyamine can be any type of polyamine. Some examples, include ethylene diamine, toluene diamine, diaminodiphenylmethane and polymethylene polyphenylene polyamines, amino alcohols, and combinations thereof. Examples of suitable amino alcohols include ethanolamine, diethanolamine, triethanolamine, and combinations thereof.

In some embodiments, an isocyanate-prepolymer is formed from polymeric methyldiphenyldiisocyanate and quasi-prepolymers of 4,4'-methyldiphenyldiisocyanate. Specific examples of suitable isocyanate-prepolymers, are commercially available from BASF® Corporation of Florham Park, N.J., under the trademark LUPRANATE®, such as LUPRANATE® MP102. It some embodiments, a combination of two or more of the aforementioned isocyanate-prepolymers may be used for forming a roadway.

In some embodiments, a polymeric isocyanate may be used. The polymeric isocyanate may include two or more NCO functional groups. The polymeric isocyanate may have an average functionality of from about 1.5 to about 3.0 such as between about 2.0 and about 2.8, for example about 2.7. The polymeric isocyanate may have an NCO content of between about 30% by weight and 33% by weight or, more specifically, between about 30.5% by weight and 32.5% by weight such as about 31.5% by weight. The polymeric isocyanate polymeric diphenylmethane diisocyanate (PMDI) or LUPRANATE® MP102.

The isocyanate-prepolymer may be present in the isocyanate component of the polyurethane precursor in an amount of between about 25% by weight and 75% by weight or, more specifically, between about 50% by weight and 75% by weight, such as between about 55% by weight and 65% by weight. A weight ratio of the isocyanate-prepolymer to the polymeric isocyanate may be 0.5 and 2.5 or, more specifically, between 1.25 and 1.75, such as about 1.5. Without being restricted to any particular theory, it is believed that a combination of the isocyanate-prepolymer and the polymeric isocyanate help with improving tensile strength, elongation, hardness, and glass transition temperature as well as tear strength of the resulting cured polyurethane relative to conventional polyurethanes.

The liquid polyurethane may further be derived from a polyol selected based on preferred viscosity and elasticity traits. For example, incorporation of a linear di-functional polyethylene glycol (polyether polyol) may result in a polyurethane that is softer and more elastic while a polyfunctional polyol will result in a harder and less elastic polyurethane. In some embodiments, a hydrophobic polyol may be used.

Some examples of such polyols include petroleum-based polyols, (i.e., a polyol derived from petroleum products and/or petroleum by-products), naturally occurring vegetable oils that contain unreacted OH functional groups (e.g., castor oil), chemically modified natural oil polyols (e.g., soybean oil, rapeseed oil, coconut oil, peanut oil, canola oil, and the like). An example of a commercially available castor oil includes T31® Castor Oil, from Eagle Specialty Products (ESP) Inc. of St. Louis, Mo. Specific examples of other suitable hydrophobic polyols include SOVERMOL® 750, SOVERMOL® 805, SOVERMOL® 1005, SOVERMOL® 1080, and SOVERMOL® 1102 available from Cognis Corporation of Cincinnati, Oreg. A weight ratio of one or more hydrophobic polyols to all polyols may be between about 80% by weight and 99% by weight or, more specifically, between about 85% and 95% by weight.

Examples of suitable solvents include dimethyl carbonate (DMC), propylene carbonate (PC), p-chlorobenzotrifluoride (PCBTF), benzotrifluoride (BTF), and rertiary-butyl acetate (TBAC). The solvent may be added to one or more isocyanates at a concentration of between about 5% by weight and 30% by weight or, more specifically, between about 10% by weight and 20% by weight.

Examples of isocyanates includes aliphatic polyisocyanate resin based on hexamethylene diisocyanate (HDI), such as DESMODUR® N3400 available from Bayer Material Science LLC in Pittsburgh, Pa. (having NCO content of 21.8±0.7%), polymethylene polyphenyl isocyanate (NCO 32%, Functionality 2.4), polymethylene polyphenyl isocyanate (NCO 32%, Functionality 2.7). When two isocyanates are used in the same precursor material, a weight ratio of each isocyanate may be between about 10% and 70% or, more specifically, between about 20% and 60% or even between about 30% and 50%.

The polyurethane material may further include a heat stabilizer to prevent degradation of the polyurethane at high temperatures. Heat stabilizers may include inorganic heat stabilizers, halogenated organic heat stabilizers, nitrogen-based heat stabilizers or combinations thereof. In certain preferred embodiments, the polyurethane material may include an inorganic heat stabilizer, such as aluminum hydroxide, magnesium hydroxide, antimony trioxide, antimony pentoxide, sodium antimonite, zinc borate, zinc stannate, zinc hydrostannate, red phosphorous, ammonium polyphosphate and combinations thereof. In some embodiments, the polyurethane material may include antimony pentoxide. The polyurethane material may include a heat stabilizer in a range of 1-10 wt. %, such as 2-5 wt. % and more specifically 2-3%.

The polyurethane material may also include a filler material. This filler material may increase the tensile strength and resistance to abrasive wear of the cured polyurethane material while decreasing the overall cost. In certain embodiments, the polyurethane material may include filler materials such as fumed silica, carbon black, mica, calcium carbonate, aluminum oxide, zirconium oxide or combinations thereof. In the same or other certain embodiments, the filler material may include recycled polyurethane from excess industrial production. An example of a suitable fumed silica is AEROSIL® R-972, commercially available from Evonic Industries Inc. of Essen, Germany. Fumed silica generally acts as a rheology control agent, and, if the fumed silica is hydrophobic, it imparts additional hydrophobicity to the polyurethane mixture. If employed, the fumed silica or another filler material may be present in the polyurethane mixture in an amount of between about 0.10% by weight and 10.0% by weight or, more typically between about 1.0% by weight and 7.0% by weight. In the same or other embodiments, the filler material may include a filler made from recycled carpet material. Used carpet materials take up significant space in landfills. Incorporation of recycled carpet materials into the polyurethane material may provide opportunities for acquisition of carbon credits.

Additives may be used to manipulate the viscoelastic properties of the polyurethane mixture in accordance with preferences for specific applications. For example, polyurethane mixtures with lower viscosity values may be preferred in applications with particularly rough surfaces or surfaces with high penetration depth requirements. In contrast, polyurethane mixtures with higher viscosity values may be preferred in applications where the polyurethane sealant should remain on a top-most surface with little to no penetration into the underlying surface. In certain embodiments, the polyurethane mixture may include a viscosity between 1 and 1,000 SSU, or more specifically between 1 and 400 SSU, and even more specifically between 1 and 250 SSU, such as 150 SSU at 78° F.

Curing times of the polyurethane mixture may be varied by incorporating various additives into the polyurethane mixture or by varying the composition of the polyurethane, filler, and heat stabilizer combination. Curing time of the urethane may be between 4 and 48 hours, such as between 8 and 48 hours, or between 16 and 48 hours, or more specifically between 20 and 30 hours. In certain embodiments, the curing time of the polyurethane mixture may be increased by reducing the weight percent of the catalyst used in formulation of the liquid polyurethane. Long curing times allow sufficient time for a full work day to be completed with sufficient time remaining to clean and remove polyurethane mixture residue from application equipment such as pumps, containers, or other tools and/or from mixing equipment before the polyurethane mixture cures.

The polyurethane material may include a catalyst to alter the properties of the polyurethane mixture, such as the viscosity, thermal stability, and/or curing time. For example, the polyurethane material may include a trimerization catalyst to increase the thermal stability of the cured material. In certain embodiments, the polyurethane material may include one or more tertiary amine catalyst and/or one or more organometallic catalyst. Examples of such catalysts include N-methyl morpholine, bismuth carboxylates, triethylenediamine, lead octoate, ferric acetylacetonate, stannous octoate, dimethyltin dilaurate, dibutylin dilaurate, dibutyltin sulfide, which have been found to favorably operate on the MDI urethanes. In certain embodiments, the polyurethane material may include one or more organometallic catalyst in a range between 0.05 to 0.8 wt. %. In certain specific embodiments, the polyurethane material may be a single-pack, water curing polymeric MDI urethane having a 2,2, dimorpholinodiethylether catalyst in about 0.05 to 0.6 wt. %. In certain embodiments, the polyurethane material may include one or more tertiary amine catalyst in a range from 0.1 to 0.4 wt. %. Other examples of suitable catalysts include N,N-demethylcyclohexylamine, 2,2'-dimorpholinodiethylether, and dibutyl tin dilaurate. The catalyst may be added to one or more isocyanates at a concentration of between about 0.05% by weight and 0.2% by weight or, more specifically, between about 0.1% by weight and 0.15% by weight.

In certain embodiments, a catalyst includes include tin (II) salts of organic carboxylic acids, e.g. tin (II) acetate, tin(II) octoate, tin(II) ethylhexanoate and tin(II) laurate. The organometallic catalyst may be dibutyltin dilaurate, which is a dialkyltin(IV) salt of an organic carboxylic acid. Specific examples of suitable organometallic catalyst, e.g. dibutyltin dilaurates, are commercially available from Air Products and Chemicals, Inc. of Allentown, Pa., under the trade name DABCO®. The organometallic catalyst can also include other dialkyltin(IV) salts of organic carboxylic acids, such as dibutyltin diacetate, dibutyltin maleate and dioctyltin diacetate.

Examples of other suitable catalysts include amine-based catalysts, bismuth-based catalysts, nickel-base catalysts, zirconium-based catalysts, zinc-based catalysts, aluminum-based catalysts, lithium based catalysts, iron(II) chloride; zinc chloride; lead octoate; tris(dialkylaminoalkyl)s-hexahydrotriazines including tris(N,N-dimethylaminopropyl)-s-hexahydrotriazine; tetraalkylammonium hydroxides including tetramethylammonium hydroxide; alkali metal hydroxides including sodium hydroxide and potassium hydroxide; alkali metal alkoxides including sodium methoxide and potassium isopropoxide; and alkali metal salts of long-chain fatty acids having from 10 to 20 carbon atoms and/or lateral OR groups. Further examples of other suitable catalysts, specifically trimerization catalysts include N,N,N-dimethylaminopropylhexahydrotriazine, potassium, potassium acetate, N,N,Ntrimethyl isopropyl amine/formate, and combinations thereof. A specific example of a suitable trimerization catalyst is commercially available from Air Products and Chemicals, Inc. under the trade name POLYCAT®. Yet further examples of other suitable catalysts, specifically tertiary amine catalysts include 1-methylimmidazol, DABCO 33-LV, dimethylaminoethanol, dimethylaminoethoxyethanol, triethylamine, N,N,N',N'-tetramethylethylenediamine, N,N-dimethylaminopropylamine, N,N,N',N',N"-pentamethyldipropylenetriamine, tris(dimethylaminopropyl)amine, N,N-dimethylpiperazine, tetramethylimino-bis(propylamine), dimethylbenzylamine, trimethylamine, triethanolamine, N,N-diethylethanolamine, N-methylpyrrolidone, N-methylmorpholine, N-ethylmorpholine, bis(2-dimethylamino-ethyl)ether, N,N-dimethylcyclohexylamine (DMCRA), N,N,N',N',N"-pentamethyl diethylenetriamine, 1,2-dimethylimidazole, 3-(dimethyl amino) propylimidazole, and combinations thereof. Specific examples of suitable tertiary amine catalysts are commercially available from Air Products and Chemicals, Inc. under the trade name POLYCAT®, e.g. POLYCAT® 41.

One or more natural polyols (NOP) additives may be included in the polyurethane mixture to decrease the viscosity of the mixture and improve the ability of the mixture to disperse in the grooves of the top surface of the bituminous pathway. Examples of suitable natural oil polyols include polyols derived from soy bean oil, peanut oil, and canola oil. Soy bean oil is a preferred polyol feed stock due to its low environmental impact, availability, and cost. In certain embodiments, it has been found that the performance of soy polyol in MDI polyurethane is improved by hydroxylating a portion of the soy polyol prior to mixing with MDI polyurethane. Example processes for hydroxylation include ozonolysis, air oxidation, autooxidation, and reaction with peroxy acids followed by reaction with nucleophiles to form hydroxyl groups on the soy polyols. Hydroxylating the soy polyol allows it to react with the MDI polyurethane to provide increase strength and flexibility to the sealed bituminous pathway or reinforced bituminous pavement, while the remaining, unreacted soy polyol acts as a plasticizer. In certain embodiments, the polyurethane mixture may include 3 to 5 wt. % soy polyols. In other embodiments, the polyurethane mixture may include 10 to 30 wt. % hydroxylated soy polyol, such as 15 to 30 wt. %, or more specifically such as 20 to 30 wt. %, or even more specifically such as 25 to 30 wt. % hydroxylated soy polyols.

In certain embodiments, the polyurethane mixture may include one or more chain extenders to modify the flexibility and tensile strength of the cured polyurethane material. Chain extenders may be used to speed up the reaction time as desired, for example, in cold environments where the curing time may be depressed due to reduced temperatures. Examples of suitable chain extenders include low molecular weight hydroxyl compounds, such as ethylene glycol and butane diol, and polyolamines such as amine terminated polyether, 2-methyl piperazine, bis(aminomethyl)cyclohexane and isomers, 1,5-diamino-3-methyl-pentane, amino ethyl piperazine ethylene diamine, diethylene triamine, aminoethyl ethanolamine, triethylene tetraamine, isophorone diamine, triethylene pentaamine, ethanol amine, lysine in any of its stereoisomeric forms and salts thereof, hexane diamine, hydrazine and piperazine which react quickly with the isocyanate function groups in the aqueous phase, or combinations thereof. Other examples of suitable chain extenders include dipropylene glycol (DPG), diethylene glycol (DEG), NIAXϕ DP-1022 available from MOMENTIVE™ in Columbus, Ohio, 1,3-propanediol, 1,4-butanediol, 1,5-pentanediol, 1,6-hexanediol, and 2-butene-1,4-diol.

The concentration of the chain extender in the overall polyol precursor may be 1.0% by weight and 20% by weight or, more specifically, between about 5% by weight and 10% by weight. It is to be appreciated that the polyol precursor may include any combination of two or more of the aforementioned chain extenders. Without being bound or limited to any particular theory, it is believed that the chain extender imparts increased strength to the resulting polyurethane, as well as increased strength, tear strength, and hardness to the elastomeric composition.

A polyol may be ethylene glycol, diethylene glycol, propylene glycol, dipropylene glycol, butane diol, glycerol, trimethylolpropane, triethanolamine, pentaerythritol, sorbitol, and combinations thereof. Specific groups of suitable polyols include polyether polyols, polyester polyols, polyether/ester polyols, and combinations thereof.

Suitable polyether polyols include products obtained by the polymerization of a cyclic oxide, for example ethylene oxide (EO), propylene oxide (PO), butylene oxide (BO), or tetrahydrofuran in the presence of polyfunctional initiators. Suitable initiator compounds contain a plurality of active hydrogen atoms, and include water, butanediol, ethylene glycol, propylene glycol (PG), diethylene glycol, triethylene glycol, dipropylene glycol, ethanolamine, diethanolamine, triethanolamine, toluene diamine, diethyl toluene diamine, phenyl diamine, diphenylmethane diamine, ethylene diamine, cyclohexane diamine, cyclohexane dimethanol, resorcinol, bisphenol A, glycerol, trimethylolpropane, 1,2,6-hexanetriol, pentaerythritol, and combinations thereof. Other suitable polyether polyols include polyether diols and triols, such as polyoxypropylene diols and triols and poly(oxyethylene-oxypropylene)diols and triols obtained by the simultaneous or sequential addition of ethylene and propylene oxides to di- or trifunctional initiators. Copolymers having oxyethylene contents of between about % by weight 5 and 90% by weight, based on the weight of the polyol component, of which the polyols may be block copolymers, random/block copolymers or random copolymers. Yet other suitable polyether polyols include polytetramethylene glycols obtained by the polymerization of tetrahydrofuran.

Suitable polyester polyols include, but are not limited to, hydroxyl-terminated reaction products of polyhydric alcohols, such as ethylene glycol, propylene glycol, diethylene glycol, 1,4-butanediol, neopentylglycol, 1,6-hexanediol, cyclohexane dimethanol, glycerol, trimethylolpropane, pentaerythritol or polyether polyols or mixtures of such polyhydric alcohols, and polycarboxylic acids, especially dicarboxylic acids or their ester-forming derivatives, for example succinic, glutaric and adipic acids or their dimethyl esters sebacic acid, phthalic anhydride, tetrachlorophthalic anhydride or dimethyl terephthalate or mixtures thereof. Polyester polyols obtained by the polymerization of lactones, e.g. caprolactone, in conjunction with a polyol, or of hydroxy carboxylic acids, e.g. hydroxy caproic acid, may also be used.

Suitable polyesteramides polyols may be obtained by the inclusion of aminoalcohols such as ethanolamine in polyesterification mixtures. Suitable polythioether polyols include products obtained by condensing thiodiglycol either alone, or with other glycols, alkylene oxides, dicarboxylic acids, formaldehyde, aminoalcohols or aminocarboxylic acids. Suitable polycarbonate polyols include products obtained by reacting diols such as 1,3-propanediol, 1,4-butanediol, 1,6-hexanediol, diethylene glycol or tetraethylene glycol with diaryl carbonates, e.g. diphenyl carbonate, or with phosgene. Suitable polyacetal polyols include those prepared by reacting glycols such as diethylene glycol, triethylene glycol or hexanediol with formaldehyde. Other suitable poly acetal polyols may also be prepared by polymerizing cyclic acetals. Suitable polyolefin polyols include hydroxy-terminated butadiene homo- and copolymers and suitable polysiloxane polyols include polydimethylsiloxane diols and triols.

Specific examples of suitable polyols are commercially available from BASF Corporation under the trademark of PLURACOL®, such as PLURACOL® GP Series polyols or, more specifically, PLURACOL® GP430 and PLURACOL® 4156.

The color of the polyurethane material may be varied through the use of dyes or pigments or through selection of specific polyurethane starting materials. For example, in certain embodiments, black polyols may be used to form polyurethane giving the resulting cured polyurethane a dark appearance. As discussed above, in general, lighter surface color results in lower absorption of heat across similar materials. The polyurethane material may be configured to be lighter in color for applications in which high heat may be problematic. For example, titanium dioxide can be used to impart a white color and carbon black can be used to impart a black color, to the elastomeric composition, respectively, while various blends of titanium dioxide and carbon black can be used to impart various shades of gray to the elastomeric composition. Examples of suitable grades of carbon black and titanium dioxide are commercially available from Columbian Chemicals Company of Marietta, Ga., and DuPont® Titanium Technologies of Wilmington, Del., respectively. Other pigments including, but not limited to, red, green, blue, yellow, green, and brown, and pigment blends thereof, can also be used to impart color to the elastomeric composition in addition to or alternative to carbon black and/or titanium dioxide. If employed, the colorant is typically present in the polyurethane mixture in an amount of between 0.10% by weight and 5.0% by weight or, more specifically, from between 1.0% by weight and 3.0% by weight.

Surfactants may be employed in certain embodiments to reduce foaming and increase the density of the cured polyurethane material to improve the long term durability of the bituminous pathway. Suitable foam stabilizing surfactants include sulfates, sulfosuccinamates, and succinamates, and other foam stabilizers known to be useful by those of skill in the art. It has been determined that, in certain, surfactants such as high molecular weight silicone surfactants having an average molecular weight in excess of 9,000 improve the wetting ability of the urethane and increase the surface contact area of the polyurethane to the top surface of the bituminous pathway. Examples of surfactants may be found in U.S. Pat. No. 5,489,617, which is incorporated herein by reference in its entirety. Relevant sections may be found in col. 3-4 of the aforementioned disclosure. Other suitable surfactants that may be employed to advantageously increase the wetting ability of the MDI polyurethane to the bituminous pathway include cationic surfactants, anionic surfactants, zwitterionic surfactants, and non-ionic surfactants. Examples of anionic surfactants include phosphates, carboxylates, and sulfonates. Examples of cationic surfactants include quaternary amines, and example non-ionic surfactants include silicone oils and block copolymers containing ethylene oxide. Suitable surfactants may be either external surfactants, which do not become chemically reacted into the polymer such as dodecyl benzene sulfonic acid and lauryl sulfonic acid salts, as well as internal surfactants such as 2,2-dimethylol propionic acid and its salts, quaternized ammonium salts, and hydrophilic species such as polyethylene oxide polyols.

In certain embodiments, the polyurethane material may include one or more plasticizer to improve the wetting ability of the polyurethane mixture to the top layer of the bituminous pathway. In certain embodiments, the polyurethane material may include between 1 and 10 wt. % plastizer. Suitable plasticizers include diisodecyl phthalate, di-n-octyl phthalate, diisobutyl phthalate, diisononyl phthalate, bis(2-ethylhexyl) phthalate, diethyl phthalate, and bis(n-butyl)phthalate. It has been found that, in certain embodiments, biodegradable plasticizers may be employed to reduce the environmental impact of the material in comparison to embodiments having non-biodegradable plasticizers. Suitable biodegradable plasticizers include triethyl citrate, acetyl triethyl citrate, tributyl citrate, acetyl tributyl citrate, trioctyl citrate, acetyl trioctyl citrate, acetyl trihexyl citrate, trimethyl citrate, and alkyl sulphonic acid phenyl ester.

Other additives may be employed to vary the physical properties of the polyurethane mixture and the cured polyurethane material. Examples of other additives may include environmentally friendly solvents to decrease viscosity or the polyurethane mixture, blowing agents, dispersants, cross linkers, light stabilizers such as ultraviolet light absorbers and hindered amine light stabilizers, acid scavengers, antistatic agents and antioxidants.

Methods of making Paving Systems

As discussed above, polyurethane materials may be used to coat a top surface of a bituminous pathway to create a sealed bituminous pathway or mixed with bituminous rubble to create a mixture, which is then allowed to cure to form a reinforced bituminous pavement, or used in combination with reclaimer-stabilizer machines to create a single or multilayer roadway. Several of these techniques may be used alone or in combination to form a roadway. For example, a polyurethane mixture may be spread over the surface by a pouring and smoothing technique. In certain preferred embodiments, a polyurethane mixture may be applied to a top surface of a base layer by spraying the polyurethane mixture using an airless sprayer. The polyurethane mixture may cover an area of the top surface of the bituminous pathway in a range of 50 to 200 square feet per gallon, such as 100 to 150 square feet per gallon. In some embodiments, in which an asphalt paving system includes an aperture such as a hole, crack or gap, the polyurethane mixture may be applied over the top surface of the asphalt paving system without the need for filling the aperture with other materials such as standard asphalt concrete repair materials like tar or hot pour bituminous liquid.

The polyurethane mixture may be applied such that the polyurethane mixture fills the aperture, or it may simply coat the surface of the aperture.

Experimental Data

A set of experiments has been conducted for samples containing 5.5% by weight of polyurethane and 94.5% by weight of decomposed granite. The size of granite was ½ minus. The mixture of the polyurethane decomposed granite was compacted to 95% (i.e., 5% voids) and cured for at least 7 days. The compressive strength of a sample tested at 20° C. was 12 MPa, while the compressive strength of 50° C. was 9 MPa. The average density of these samples was 2.1 g/cm3. The test was performed in accordance with ASTM D1074-09.

Another test was conducted to determine slip resistance according to ASTM E 303. The sample was prepared using 5% by weight of polyurethane and 95% by weight of decomposed granite. The sample was cured for 14 days. The slip resistance results for dry samples was 64, while the result for wet samples was 56, which is substantially higher than the value of 36 recommended by the Ceramic Tile Institute of America. Yet another test was conducted according to ANSI B101.3 to determine a wet dynamic friction. The samples had a dynamic coefficient of friction (DCOF) of 0.67. These slip characteristics are particularly important for trail and walkway types of applications. Trails can get very slipper and have moving surfaces especially after rain and may not be accessible to people with disabilities. The law in many countries now started requiring the trails with slip resistance of at least 36 (according to ANSI B101.3) that have hard firm surfaces even when wet. As evident from the experimental data above, polyurethane based pathways (collectively referred to as roadways) can be formed to meet and far exceed this standard while providing long lasting pathways for various applications. This slip resistance is also attractive for automotive roads as these roads can get very slippery during the rain.

Conclusion

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A method of forming a roadway, the method comprising:

providing a reclaimer-stabilizer machine, wherein the reclaimer-stabilizer machine is configured to pulverize an in situ soil and to combine at least one polyurethane precursor into the pulverized in situ soil;

pulverizing the in situ soil using the reclaimer-stabilizer machine;

combining the pulverized in situ soil with the at least one polyurethane precursor using the reclaimer-stabilizer machine, wherein the combining forms a polyurethane filled soil material, wherein a concentration of the at least one polyurethane precursor in the polyurethane filled soil material is between about 2% by weight and 20% by weight; and compacting the polyurethane filled soil material using the reclaimer-stabilizer machine, wherein the compacting forms a layer of the roadway.

2. The method of claim 1, wherein the layer of the roadway is a wear layer.

3. The method of claim 1, wherein the layer of the roadway is impermeable to water after curing the polyurethane filled soil material.

4. The method of claim 1, further comprising adjusting a moisture content of the pulverized in situ soil using the reclaimer-stabilizer machine, wherein the adjusting comprises adding water into the pulverized in situ soil or removing water from the pulverized in situ soil.

5. The method of claim 1, wherein the at least one polyurethane precursor comprises a first polyurethane precursor and a second polyurethane precursor, wherein the first polyurethane precursor comprises isocyanate and wherein the second polyurethane precursor comprises polyol.

6. The method of claim 5, wherein the first polyurethane precursor and the second polyurethane precursor are mixed using the reclaimer-stabilizer machine prior combining with the pulverized in situ soil.

7. The method of claim 5, wherein the first polyurethane precursor and the second polyurethane precursor are individually dispensed and are mixed together while being combined with the pulverized in situ soil using the reclaimer-stabilizer machine.

8. The method of claim 5, wherein the first polyurethane precursor and the second polyurethane precursor are at least partially mixed during dispensing of the first polyurethane precursor and the second polyurethane precursor and before combining the first polyurethane precursor and the second polyurethane precursor with the pulverized in situ soil using the reclaimer-stabilizer machine.

9. The method of claim 1, wherein the at least one polyurethane precursor comprises one of isocyanate or isocyanate-containing prepolymer, and wherein substantially no polyol is dispensed into the pulverized in situ soil.

10. The method of claim 1, further comprising adding a reinforced component into the pulverized in situ soil, wherein the reinforced component comprises a material selected from the group comprising basalt fibers, silica fibers, glass fibers, and polypropylene fibers.

11. The method of claim 10, wherein the reinforced component comprises basalt fibers.

12. The method of claim 10, wherein the reinforced component is added as a part of the at least one polyurethane precursor.

13. The method of claim 10, wherein the reinforced component is added separately from the at least one polyurethane precursor.

14. The method of claim 10, wherein the reinforced component further comprises a dispersing agent, the dispersing agent comprises one of sand or fumed silica.

15. The method of claim 1, wherein the at least one polyurethane precursor comprises a heat stabilizer selected from a group consisting of aluminum hydroxide, magnesium hydroxide, antimony trioxide, antimony pentoxide, sodium antimonite, zinc borate, zinc stannate, zinc hydrostannate, red phosphorous, ammonium polyphosphate and combinations thereof.

16. The method of claim 1, wherein the layer of the roadway comprises between 1% and 10% by weight of polyurethane.

17. The method of claim 1, wherein the at least one polyurethane precursor has a viscosity of between 20 centipoise and 2000 centipoise at 78 degrees Fahrenheit.

18. The method of claim 1, wherein the layer of the roadway has a thickness of between 0.5 inches and 15 inches.

19. The method of claim 1, wherein a water content in the polyurethane filled soil material is between about 5% and 20% by weight.

20. The method of claim 1, wherein the at least one polyurethane precursor comprises between about 5% and 50% of naphthenic and aromatic process oils.

* * * * *